US010774611B1

(12) United States Patent
Harbi

(10) Patent No.: US 10,774,611 B1
(45) Date of Patent: Sep. 15, 2020

(54) METHOD AND SYSTEM FOR MICROANNULUS SEALING BY GALVANIC DEPOSITION

(71) Applicant: SAUDI ARABIAN OIL COMPANY, Dhahran (SA)

(72) Inventor: Atallah N. Harbi, Dammam (SA)

(73) Assignee: SAUDI ARABIAN OIL COMPANY (SA)

( * ) Notice: Subject to any disclaimer, the term of this patent is extended or adjusted under 35 U.S.C. 154(b) by 0 days.

(21) Appl. No.: 16/579,116

(22) Filed: Sep. 23, 2019

(51) Int. Cl.
*E21B 33/13* (2006.01)
*E21B 33/14* (2006.01)

(52) U.S. Cl.
CPC ..... *E21B 33/13* (2013.01); *E21B 33/14* (2013.01)

(58) Field of Classification Search
None
See application file for complete search history.

(56) References Cited

U.S. PATENT DOCUMENTS

| | | | |
|---|---|---|---|
| 2,034,347 | A | 3/1936 | Loomis et al. |
| 3,756,315 | A | 9/1973 | Suman, Jr. et al. |
| 4,092,052 | A | 5/1978 | Terry |
| 4,436,148 | A | 3/1984 | Maxwell |
| 5,273,112 | A | 12/1993 | Schultz |
| 5,316,086 | A | 5/1994 | DeMoss |
| 6,186,239 | B1 | 2/2001 | Monjure et al. |
| 6,218,343 | B1 | 4/2001 | Burts, Jr. |
| 6,457,528 | B1 | 10/2002 | Staudt |
| 6,959,767 | B2 | 11/2005 | Horton et al. |
| 6,991,045 | B2 | 1/2006 | Vinegar et al. |
| 7,575,052 | B2 | 8/2009 | Sandberg et al. |
| 7,699,101 | B2 | 4/2010 | Fripp et al. |
| 7,909,987 | B2 | 3/2011 | Kurtz et al. |
| 9,163,467 | B2 | 10/2015 | Gaudette et al. |
| 9,394,757 | B2 | 7/2016 | Lowry et al. |
| 9,863,201 | B2 | 1/2018 | Fripp et al. |
| 9,879,519 | B2 | 1/2018 | Roberson et al. |
| 10,125,568 | B2 | 11/2018 | Fripp et al. |
| 2003/0019621 | A1* | 1/2003 | Schultz ..... E21B 41/0085 166/65.1 |
| 2012/0073568 | A1 | 3/2012 | Kapelanczyk et al. |

(Continued)

*Primary Examiner* — Andrew Sue-Ako
(74) *Attorney, Agent, or Firm* — Bracewell LLP; Constance Gall Rhebergen

(57) ABSTRACT

Embodiments provide a system and method for treating a casing-casing annulus (CCA) of a wellbore using galvanic deposition. A galvanic deposition system includes a first casing, a second casing, an anode, a brine, and a power source. The first casing includes a first conductive material. The second casing includes a second conductive material. The first casing has an inner diameter greater than an outer diameter of the second casing forming the CCA. The anode includes an anodic material. The brine is fluidly contacting an interior surface of the first casing, an exterior surface of the second casing, and the anode. The power source is electrically connecting the anode and at least one of the first casing and the second casing. The at least one of the first casing and the second casing is operable as a cathode. The power source is configured to provide an electric current to the galvanic deposition system such that galvanic deposition occurs on at least one of the interior surface of the first casing and the exterior surface of the second casing.

29 Claims, 2 Drawing Sheets

(56) References Cited

U.S. PATENT DOCUMENTS

| | | | | |
|---|---|---|---|---|
| 2013/0209175 | A1* | 8/2013 | Keyworth | E21B 17/01<br>405/184.1 |
| 2013/0277046 | A1 | 10/2013 | Haroun et al. | |
| 2018/0265682 | A1 | 9/2018 | Roy et al. | |

* cited by examiner

METHOD AND SYSTEM FOR MICROANNULUS SEALING BY GALVANIC DEPOSITION

BACKGROUND

Field of the Disclosure

Embodiments of the disclosure generally relate to treating casing-casing annulus pressure. More specifically, embodiments of the disclosure relate to system and method for treating casing-casing annulus pressure using galvanic deposition.

Description of the Related Art

After or during the drilling of a wellbore, the wellbore is lined with a metallic pipe referred to as a casing. Cement slurry is pumped between the annulus created by the casing and the wellbore wall and subsequently allowed to harden, forming a structural component of the wellbore. The casing prevents the wellbore wall from caving into the wellbore and maintains control of formation fluids and the pressure of the formation fluids. Multiple casings of different diameters can be lined in the wellbore where cement can be positioned between each annulus created by two adjacent casings (as known as the casing-casing annulus (CCA)) to provide additional structural stability to the wellbore.

In cases, the hardened cement may include certain pores or imperfections such as cracks, microannuli, microchannels, and fractures. Formation fluids such as oil, water, and gases may build up and pressurize the imperfections, which act as pathways for the formation fluids to migrate to the surface creating environmental and safety hazards. A cement slurry may be pumped downhole in attempt to plug these pores or imperfections. However, the cement slurry includes solid materials of various sizes greater than those of the pores or imperfections located on the uphole surface of the hardened cement, where the surface pores or imperfections prevent such solid materials from accessing other pores or imperfections further downhole. In addition, resin-based sealants may be pumped downhole in attempt to plug these pores or imperfections. However, due to the viscosity of the resin-based sealants, the resin-based sealants are not able to access the pores or imperfections further downhole.

SUMMARY

Embodiments of the disclosure generally relate to treating casing-casing annulus pressure. More specifically, embodiments of the disclosure relate to system and method for treating casing-casing annulus pressure using galvanic deposition.

Embodiments of the disclosure provide a galvanic deposition system for treating a CCA of a wellbore. The galvanic deposition system includes a first casing, a second casing, an anode, a brine, and a power source. The first casing includes a first conductive material. The second casing includes a second conductive material. The first casing has an inner diameter greater than an outer diameter of the second casing forming the CCA. The anode includes an anodic material. The brine is fluidly contacting an interior surface of the first casing, an exterior surface of the second casing, and the anode. The power source is electrically connecting the anode and at least one of the first casing and the second casing. The at least one of the first casing and the second casing is operable as a cathode. The power source is configured to provide an electric current to the galvanic deposition system such that galvanic deposition occurs on at least one of the interior surface of the first casing and the exterior surface of the second casing.

In some embodiments, the CCA includes a cemented zone. In some embodiments, galvanic deposition is configured to occur in pores or imperfections of the cemented zone such that formation fluids are prevented from migrating to a surface of the wellbore.

In some embodiments, the anode is a consumable anode. In some embodiments, the anodic material includes gold, platinum, silver, copper, lead, tin, nickel, cobalt, cadmium, iron, chromium, zinc, manganese, aluminum, and combinations of the same. In some embodiments, the anode is a non-consumable anode. The brine includes metal cations including $Au^{+}$, $Au^{3+}$, $Pt^{2+}$, $Ag^{+}$, $Cu^{+}$, $Cu^{2+}$, $Pb^{2+}$, $Sn^{2+}$, $Ni^{2+}$, $Co^{2+}$, $Cd^{2+}$, $Fe^{2+}$, $Fe^{3+}$, $Cr^{3+}$, $Zn^{2+}$, $Mn^{2+}$, $Al^{3+}$, and combinations of the same.

In some embodiments, the at least one of the interior surface of the first casing and the exterior surface of the second casing is at least partially coated with an insulating material. In some embodiments, the insulating material includes epoxys, resins, elastomers, plastics, and combinations of the same.

In some embodiments, the galvanic deposition system further includes a wellhead. The wellhead is positioned uphole of the first casing and the second casing. The wellhead is sealing the CCA and electrically connecting the at least one of the first casing and the second casing. The brine is fluidly contacting interior surface of the wellhead. In some embodiments, the wellhead includes a port configured to bleed pressurized formation fluids to a surface of the wellbore or to inject brine into the CCA. In some embodiments, the interior surfaces of the wellhead are coated with an insulating material including epoxys, resins, elastomers, plastics, and combinations of the same.

In some embodiments, the galvanic deposition system includes a tank. The brine is fluidly contacting interior surfaces of the tank. The tank includes the anode being submerged in the brine. In some embodiments, the tank includes a port configured to replenish the anodic material. In some embodiments, the interior surfaces of the tank are coated with an insulating material including epoxys, resins, elastomers, plastics, and combinations of the same.

Embodiments of the disclosure also provide a method for treating a CCA of a wellbore using galvanic deposition. The method includes the step of deploying an anode and a power source such that the power source is electrically connecting the anode and at least one of a first casing and a second casing. The at least one of the first casing and the second casing is operable as a cathode. The anode includes an anodic material. The first casing includes a first conductive material. The second casing includes a second conductive material. The first casing has an inner diameter greater than an outer diameter of the second casing forming the CCA. The method includes the step of injecting a brine in the CCA such that the brine is fluidly contacting an interior surface of the first casing, an exterior surface of the second casing, and the anode. The method includes the step of providing an electric current via the power source such that galvanic deposition occurs on at least one of the interior surface of the first casing and the exterior surface of the second casing.

In some embodiments, the method further includes the step of deploying the first casing and the second casing in the wellbore. In some embodiments, the method further includes the step of introducing a cement slurry in the CCA. The method further includes the step of allowing the cement slurry to harden to form a cemented zone. In some embodiments, galvanic deposition occurs in pores or imperfections of the cemented zone such that formation fluids are prevented from migrating to a surface of the wellbore.

In some embodiments, the anode is a consumable anode. In some embodiments, the anodic material includes gold, platinum, silver, copper, lead, tin, nickel, cobalt, cadmium, iron, chromium, zinc, manganese, aluminum, and combinations of the same. In some embodiments, the anode is a non-consumable anode. The brine includes metal cations including $Au^{+}$, $Au^{3+}$, $Pt^{2+}$, $Ag^{+}$, $Cu^{+}$, $Cu^{2+}$, $Pb^{2+}$, $Sn^{2+}$, $Ni^{2+}$, $Co^{2+}$, $Cd^{2+}$, $Fe^{2+}$, $Fe^{3+}$, $Cr^{3+}$, $Zn^{2+}$, $Mn^{2+}$, $Al^{3+}$, and combinations of the same.

In some embodiments, the at least one of the interior surface of the first casing and the exterior surface of the second casing is at least partially coated with an insulating material. In some embodiments, the insulating material includes epoxys, resins, elastomers, plastics, and combinations of the same.

In some embodiments, the method further includes the step of positioning a wellhead uphole of the first casing and the second casing sealing the CCA and electrically connecting the at least one of the first casing and the second casing. The brine is fluidly contacting interior surfaces of the wellhead. In some embodiments, the method further includes the step of bleeding pressurized formation fluids to a surface of the wellbore via a port of the wellhead. In some embodiments, the interior surfaces of the wellhead are coated with an insulating including epoxys, resins, elastomers, plastics, and combinations of the same.

In some embodiments, the anode is positioned in a tank and is submerged in the brine. The brine is fluidly contacting interior surfaces of the tank. In some embodiments, the interior surfaces of the tank are coated with an insulating material including epoxys, resins, elastomers, plastics, and combinations of the same.

In some embodiments, the method further includes the step of replenishing the anodic material.

BRIEF DESCRIPTION OF THE DRAWINGS

So that the manner in which the previously-recited features, aspects, and advantages of the embodiments of this disclosure as well as others that will become apparent are attained and can be understood in detail, a more particular description of the disclosure briefly summarized previously may be had by reference to the embodiments that are illustrated in the drawings that form a part of this specification. However, it is to be noted that the appended drawings illustrate only certain embodiments of the disclosure and are not to be considered limiting of the disclosure's scope as the disclosure may admit to other equally effective embodiments.

Figure 1:
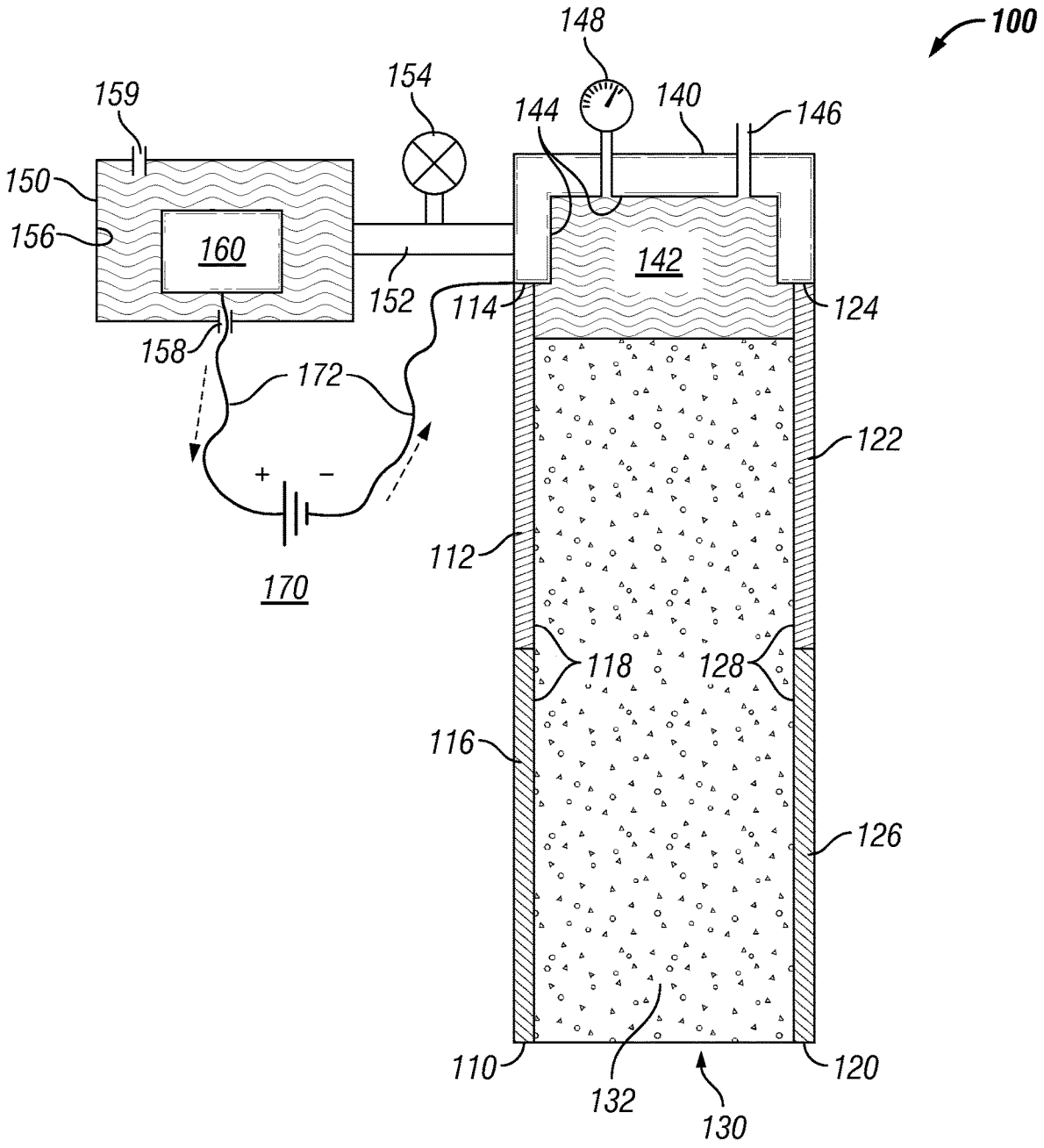
FIG. 1 is a schematic view of a galvanic deposition system according to an embodiment of the disclosure.

In the accompanying Figures, similar components or features, or both, may have a similar reference label.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the word "about" includes +/−5% of the cited magnitude.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words, including "uphole," "downhole" and other like terms, are for descriptive convenience and are not limiting unless otherwise indicated.

As used throughout the disclosure, the term "brine" refers to an aqueous solution of inorganic salts. Non-limiting example inorganic salts used in the preparation of brine include sodium chloride, calcium chloride, potassium chloride, zinc-based salts, bromide-based salts, and iodine-based salts.

Figure 2:
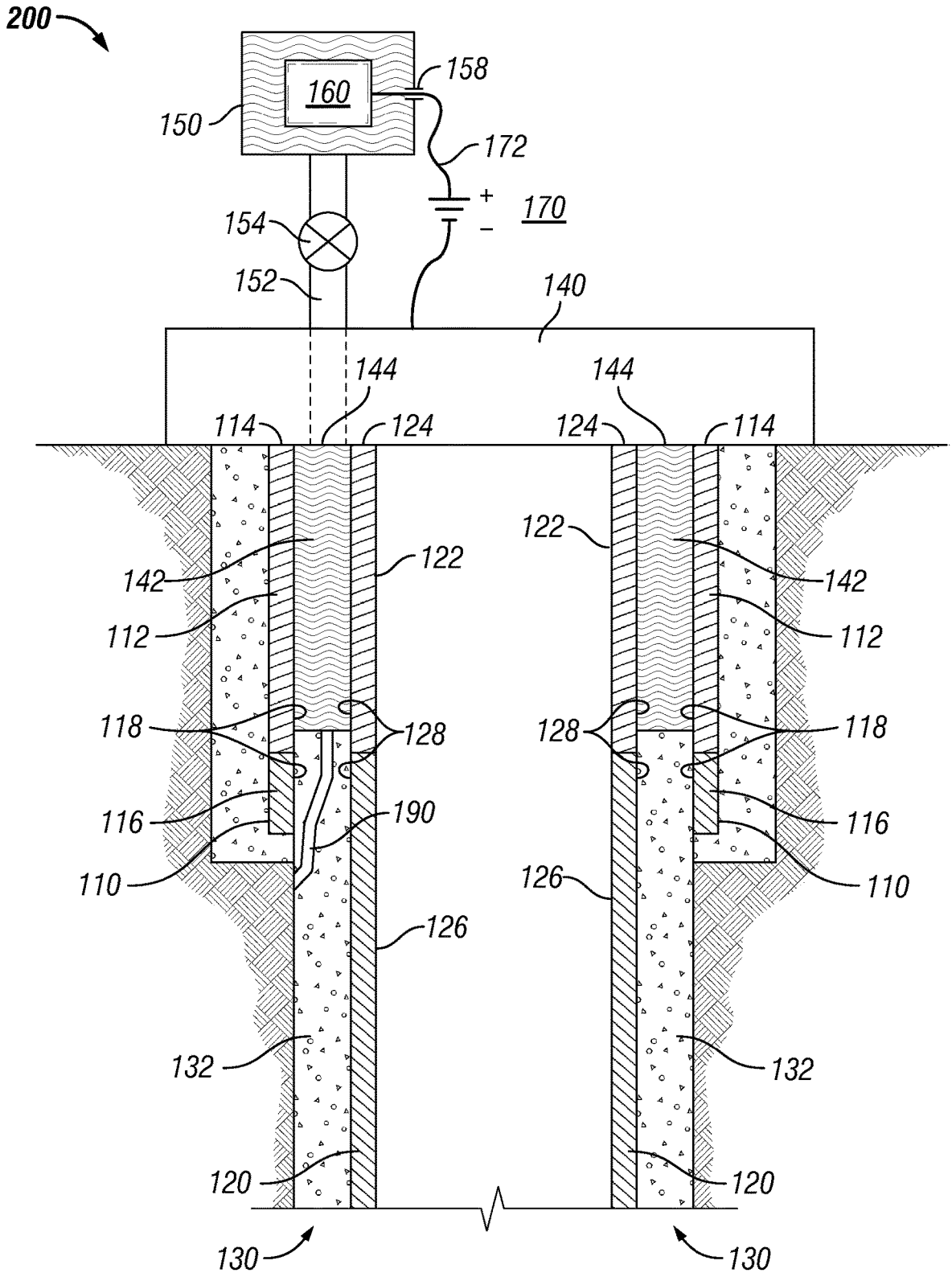
FIG. 2 is a schematic view of a galvanic deposition system according to an embodiment of the disclosure.

FIG. 1 shows a schematic view of a galvanic deposition system 100 according to an embodiment of the disclosure. FIG. 2 shows a schematic view of a galvanic deposition system 200 according to an embodiment of the disclosure. As shown in FIGS. 1 and 2, the galvanic deposition systems 100, 200 include a first casing 110 and a second casing 120. Non-limiting example materials used for the first casing 110 and the second casing 120 include conductive materials such as carbon steel (with or without heat treatment), stainless steel, aluminum, titanium, or any like metal or alloy. The first casing 110 has an inner diameter greater than the outer diameter of the second casing 120. For example, the first casing 110 may have an inner diameter of about 24 inches and the second casing 120 may have an outer diameter of about 18⅝ inches. One skilled in the art would recognize that the casings 110, 120 can have any inner or outer diameters and wall thicknesses so long as the inner diameter of the first casing 110 is greater than the outer diameter of the second casing 120 to create the CCA 130. The CCA 130 is located between the annulus created by the inner diameter of the first casing 110 and outer diameter of the second casing 120. The CCA 130 includes a cemented zone 132 filled with hardened cement that may have pores or imperfections 190 that serve as pathways for formation fluids to migrate to the surface. Non-limiting example cements used for the hardened cement include all types of Portland cements, any type of cement as classified by the American Society for Testing and Materials (ASTM), such as Type I, II, III, or V, and any type of cement as classified by the American Petroleum Institute (API), such as Class A, C, G, or H. Portland cements are described in API specification for "Materials and Testing for Well Cements," API 10B-2 of the API.

The interior surface 118 of an uphole section 112 of the first casing 110 is coated with an insulating material at a predetermined depth from the upholemost edge 114 of the first casing 110. The exterior surface 128 of an uphole section 122 of the second casing 120 is also coated with an insulating material at a predetermined depth from the upholemost edge 124 of the second casing 120. The insulating material is corrosion resistant and serves as to prevent galvanic deposition on the interior surface of the uphole section 112 of the first casing 110 and the exterior surface of the uphole section 122 of the second casing 120, in order to selectively target the desired galvanic deposition zone. The insulating materials can include any suitable insulating polymer such as epoxys, resins, elastomers, and plastics that can be coated and adhered onto a metallic casing to prevent galvanic deposition on undesired sections of the first casing 110 and the second casing 120.

On the other hand, the interior surface 118 of a downhole section 116 of the first casing 110 and the exterior surface 128 of a downhole section 126 of the second casing 120 are not coated with the insulating material. In this manner, the bare metallic surfaces of the interior surface 118 of the first casing 110 and the exterior surface 128 of the second casing 120 are in contact with the cemented zone 132 in the CCA 130. Galvanic deposition occurs on or in the vicinity of the uncoated bare casings where the downhole sections 116, 126 may serve as cathodes.

In other embodiments, the interior surface 118 of the first casing 110 is completely coated with the insulating material while the exterior surface 128 of the second casing 120 is partially coated or not coated with the insulating material. Still in other embodiments, the exterior surface 128 of the second casing 120 is completely coated with the insulating material while the interior surface 118 of the first casing 110 is partially coated or not coated with the insulating material.

In some embodiments, the first casing 110 can include more than one casing joints assembled together via a threaded connection at each end. The interior surfaces 118 of one or more casing joints of the first casing 110 can be coated with the insulating material. Likewise, the second casing 120 can include more than one casing joints assembled together via a threaded connection at each end. The exterior surfaces 128 of one or more casing joints of the second casing 120 can be coated with the insulating material.

A wellhead 140 is located uphole of the first casing 110 and the second casing 120 and is in electrical contact with the upholemost edges 114, 124 of the first casing 110 and the second casing 120, respectively. The wellhead 140 seals the CCA 130 creating a non-cemented wellhead cavity 142 uphole of the cemented zone 132. The wellhead 140 can include a pressure gauge 148 to measure the pressure buildup caused by the formation fluids. The wellhead 140 can include one or more ports 146 either to bleed pressurized formation fluids to the surface or to inject brine into the CCA 130, or both. Brine is pumped into the CCA 130 such that the wellhead cavity 142 and pores or imperfections 190 of the cemented zone 132 are filled with the brine. The brine serves as an electrolyte medium and is in contact with the interior surface 118 of the uncoated downhole section 116 of the first casing 110 and the exterior surface 128 of the uncoated downhole section 126 of the second casing 120, which may serve as cathodes. Non-limiting example materials used for the wellhead 140 include conductive materials such as carbon steel (with or without heat treatment), stainless steel, aluminum, titanium, or any like metal or alloy. The interior surfaces 144 of the wellhead 140 are coated with an insulating material. The insulating material is corrosion resistant and serves as to prevent galvanic deposition on the interior surfaces 144 of the wellhead 140, in order to selectively target the desired galvanic deposition zone. The insulating material can include any suitable insulating polymer such as epoxys, resins, elastomers, and plastics that can be coated and adhered onto the interior surfaces 144 of the wellhead 140 to prevent undesired galvanic deposition on the wellhead 140.

The non-cemented wellhead cavity 142 created by the wellhead 140 is in fluid contact with a tank 150 via pipe 152 along with a valve 154. Both the tank 150 and the pipe 152 is filled with the brine. The tank 150 includes an anode 160 that is submerged in and in contact with the brine. The tank 150 can include a port 158 to electrically connect the anode 160 and a power source 170. The tank 150 can include a port 159 to replenish anodic material as the anode 160 is consumed during galvanic deposition. The anode 160 can include a consumable anode 160. Non-limiting example anodic materials include elemental forms of gold, platinum, silver, copper, lead, tin, nickel, cobalt, cadmium, iron, chromium, zinc, manganese, and aluminum. Generally speaking, the consumable anode 160 includes a metallic material that is to be galvanically deposited on the cathode or in the vicinity of the cathode. In some embodiments, the interior surface (not shown) of the pipe 152 and the interior surface 156 of the tank 150 are coated with an insulating material. The insulating material is corrosion resistant and serves as to prevent galvanic deposition on the interior surface of the pipe 152 and the interior surface 156 of the tank 150, in order to selectively target the desired galvanic deposition zone. The insulating material can include any suitable insulating polymer such as epoxys, resins, elastomers, and plastics that can be coated and adhered onto the interior surface of the pipe 152 and the interior surface 156 of the tank 150 to prevent undesired galvanic deposition on the pipe 152 and the tank 150.

A power source 170 is in electrical contact with the anode 160. The power source 170 is also in electrical contact with one or more cathodic components, including the wellhead 140, the first casing 110, and the second casing 120. The power source 170 provides direct current (DC) to the galvanic deposition system 100, forming an electric circuit with external wiring 172, the brine, the cathodic components, and the anode 160, such that galvanic deposition can occur.

As the power source 170 provides DC to the galvanic deposition system 100, oxidation occurs at the anode 160 where each oxidizing metal atom loses one or more electrons to become a metal cation dissolved in the brine. Non-limiting example metal cations include $Au^{+}$, $Au^{3+}$, $Pt^{2+}$, $Ag^{+}$, $Cu^{+}$, $Cu^{2+}$, $Pb^{2+}$, $Sn^{2+}$, $Ni^{2+}$, $Co^{2+}$, $Cd^{2+}$, $Fe^{2+}$, $Fe^{3+}$, $Cr^{3+}$, $Zn^{2+}$, $Mn^{2+}$, and $Al^{3+}$. The electrons generated by oxidation in the anode 160 migrate through the power source 170 via the external wiring 172 to the cathodic components. The dissolved metal cations migrate from the tank 150 through the wellhead cavity 142 and the brine-abundant cemented zone 132 to the cathodic components, namely, the interior surface 118 of the uncoated downhole part 116 of the first casing 110 and the exterior surface 128 of the uncoated downhole part 126 of the second casing 120. Without being bound by any theory, the dissolved metal cations are minimally or not affected by the permeability of the cemented zone 132 due to their ionic radii size. Reduction occurs on or in the vicinity of the cathodic components, where each migrated metal cation gains one or more electrons to convert to their elemental form. As a result, the anodic material is galvanically deposited on the cathodic components. As the power source 170 continues to provide DC to the galvanic deposition system 100, the anodic material is galvanically deposited further in the cemented zone 132 such that the pores or imperfections 190 of the cemented zone 132 are occupied with the anodic material. In this manner, formation fluids are prevented from migrating to the surface due to the galvanically deposited anodic material plugging possible pathways for pressure buildup. Because the brine has a lesser viscosity than conventional sealants such as cement slurries or resins, the brine can access deeper pore spaces in the cemented zone 132 of the CCA 130 than conventional sealants such as cement slurries and resin-based selants. Resultantly, metal cations dissolved in the brine during galvanic deposition can access such pore spaces to plug certain zones in the CCA 130 whereas conventional sealants cannot.

In other embodiments, the anode 160 can include a non-consumable anode such as carbon. When using a non-consumable anode, the metal to be galvanically deposited at or in the vicinity of the cathodic components are provided in an electrolyte solution where the metal exists in its cationic form. The electrolyte solution containing metal cations can be periodically replenished via the port 159 of the tank 150 as the metal cations are reduced to their elemental form on or in the vicinity of the cathodic components.

In an example embodiment of the method, a wellbore is drilled and the first casing 110 and the second casing 120 are deployed in the wellbore. The first casing 110 has an inner diameter greater than an outer diameter of the second casing 120 forming the CCA 130. Before or after deployment of the first casing 110 and the second casing 120, either the interior surface 118 of the first casing 110 or the exterior surface 128 of the second casing 120, or both, are at least partially coated with the insulating material. After deployment, a cement slurry is introduced in the CCA 130 and is allowed to harden. The wellhead 140 having its interior surfaces 144 coated with the insulating material is placed uphole of the first casing 110 and the second casing 120 making electrical contact with the first casing 110 and the second casing 120 and sealing the CCA 130. Through port 146, any pressurized formation fluids can be bled to the surface. Brine can be pumped into the CCA 130 through port 146 such that the wellhead cavity 142 and pores or imperfections 190 of the cemented zone 132 are filled with the brine. The brine is fluidly contacting the uncoated surfaces of the first casing 110 and the second casing 120. The tank 150 is fluidly connected to the wellhead 140 where the tank 150 includes the anode 160 submerged in the brine. Via port 158, the anode 160 is connected to the power source 170. The power source 170 is also connected to one or more of the wellhead 140, the first casing 110, and the second casing 120, which serves as the cathode. DC is provided for a predetermined period to the galvanic deposition system 100 such that oxidation occurs at the anode 160 and reduction occurs at the cathode galvanically depositing the anodic material on or in the vicinity of the cathode, including the cemented zone 132 of the CCA 130. Optionally, the anodic material can be replenished via port 159 as the anode 160 is consumed during galvanic deposition. Galvanic deposition can be continued until the pressure gauge 148 shows minimal or about zero pressure build up, which is indicative of the pores or imperfections 190 of the cemented zone 132 being plugged due to the galvanically deposited anodic material.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A galvanic deposition system for treating a casing-casing annulus (CCA) of a wellbore, the galvanic deposition system comprising:

a first casing, the first casing comprising a first conductive material;

a second casing, the second casing comprising a second conductive material, the first casing having an inner diameter greater than an outer diameter of the second casing forming the CCA;

an anode, the anode comprising an anodic material;

a brine, the brine fluidly contacting an interior surface of the first casing, an exterior surface of the second casing, and the anode; and a power source, the power source electrically connecting the anode and at least one of the first casing and the second casing, wherein the at least one of the first casing and the second casing is operable as a cathode, wherein the power source is configured to provide an electric current to the galvanic deposition system such that galvanic deposition occurs on at least one of the interior surface of the first casing and the exterior surface of the second casing.

2. The galvanic deposition system of claim 1, wherein the CCA includes a cemented zone.

3. The galvanic deposition system of claim 2, wherein galvanic deposition is configured to occur in pores or imperfections of the cemented zone such that formation fluids are prevented from migrating to a surface of the wellbore.

4. The galvanic deposition system of claim 1, wherein the anode is a consumable anode.

5. The galvanic deposition system of claim 4, wherein the anodic material is selected from the group consisting of: gold, platinum, silver, copper, lead, tin, nickel, cobalt, cadmium, iron, chromium, zinc, manganese, aluminum, and combinations of the same.

6. The galvanic deposition system of claim 1, wherein the anode is a non-consumable anode, wherein the brine includes metal cations selected from the group consisting of: $Au^{+}$, $Au^{3+}$, $Pt^{2+}$, $Ag^{+}$, $Cu^{+}$, $Cu^{2+}$, $Pb^{2+}$, $Sn^{2+}$, $Ni^{2+}$, $Co^{2+}$, $Cd^{2+}$, $Fe^{2+}$, $Fe^{3+}$, $Cr^{3+}$, $Zn^{2+}$, $Mn^{2+}$, $Al^{3+}$, and combinations of the same.

7. The galvanic deposition system of claim 1, wherein the at least one of the interior surface of the first casing and the exterior surface of the second casing is at least partially coated with an insulating material.

8. The galvanic deposition system of claim 7, wherein the insulating material is selected from the group consisting of: epoxys, resins, elastomers, plastics, and combinations of the same.

9. The galvanic deposition system of claim 1, further comprising:

a wellhead, the wellhead positioned uphole of the first casing and the second casing, the wellhead sealing the CCA and electrically connecting the at least one of the first casing and the second casing, the brine fluidly contacting interior surfaces of the wellhead.

10. The galvanic deposition system of claim 9, wherein the wellhead includes a port configured to bleed pressurized formation fluids to a surface of the wellbore or to inject brine into the CCA.

11. The galvanic deposition system of claim 9, wherein the interior surfaces of the wellhead are coated with an insulating material selected from the group consisting of: epoxys, resins, elastomers, plastics, and combinations of the same.

12. The galvanic deposition system of claim 1, further comprising:

a tank, the brine fluidly contacting interior surfaces of the tank, wherein the tank includes the anode being submerged in the brine.

13. The galvanic deposition system of claim 12, wherein the tank includes a port configured to replenish the anodic material.

14. The galvanic deposition system of claim 12, wherein the interior surfaces of the tank are coated with an insulating material selected from the group consisting of: epoxys, resins, elastomers, plastics, and combinations of the same.

15. A method for treating a casing-casing annulus (CCA) of a wellbore using galvanic deposition, the method comprising the steps of:

deploying an anode and a power source such that the power source is electrically connecting the anode and at least one of a first casing and a second casing, the at least one of the first casing and the second casing operable as a cathode, wherein the anode comprises an anodic material, wherein the first casing includes a first conductive material, wherein the second casing includes a second conductive material, wherein the first casing has an inner diameter greater than an outer diameter of the second casing forming the CCA;

injecting a brine in the CCA such that the brine is fluidly contacting an interior surface of the first casing, an exterior surface of the second casing, and the anode;

providing an electric current via the power source such that galvanic deposition occurs on at least one of the interior surface of the first casing and the exterior surface of the second casing.

16. The method of claim 15, further comprising the step of:

deploying the first casing and the second casing in the wellbore.

17. The method of claim 15, further comprising the steps of:

introducing a cement slurry in the CCA; and allowing the cement slurry to harden to form a cemented zone.

18. The method of claim 17, wherein galvanic deposition occurs in pores or imperfections of the cemented zone such that formation fluids are prevented from migrating to a surface of the wellbore.

19. The method of claim 15, wherein the anode is a consumable anode.

20. The method of claim 19, wherein the anodic material is selected from the group consisting of: gold, platinum, silver, copper, lead, tin, nickel, cobalt, cadmium, iron, chromium, zinc, manganese, aluminum, and combinations of the same.

21. The method of claim 15, wherein the anode is a non-consumable anode, wherein the brine includes metal cations selected from the group consisting of: $Au^{+}$, $Au^{3+}$, $Pt^{2+}$, $Ag^{+}$, $Cu^{+}$, $Cu^{2+}$, $Pb^{2+}$, $Sn^{2+}$, $Ni^{2+}$, $Co^{2+}$, $Cd^{2+}$, $Fe^{2+}$, $Fe^{3+}$, $Cr^{3+}$, $Zn^{2+}$, $Mn^{2+}$, $Al^{3+}$, and combinations of the same.

22. The method of claim 15, wherein the at least one of the interior surface of the first casing and the exterior surface of the second casing is at least partially coated with an insulating material.

23. The method of claim 22, wherein the insulating material is selected from the group consisting of: epoxys, resins, elastomers, plastics, and combinations of the same.

24. The method of claim 15, further comprising the step of:

positioning a wellhead uphole of the first casing and the second casing sealing the CCA and electrically connecting the at least one of the first casing and the second casing, wherein the brine is fluidly contacting interior surfaces of the wellhead.

25. The method of claim 24, further comprising the step of:

bleeding pressurized formation fluids to a surface of the wellbore via a port of the wellhead.

26. The method of claim 24, wherein the interior surfaces of the wellhead are coated with an insulating material selected from the group consisting of: epoxys, resins, elastomers, plastics, and combinations of the same.

27. The method of claim 15, wherein the anode is positioned in a tank and is submerged in the brine, wherein the brine is fluidly contacting interior surfaces of the tank.

28. The method of claim 27, wherein the interior surfaces of the tank are coated with an insulating material selected from the group consisting of: epoxys, resins, elastomers, plastics, and combinations of the same.

29. The method of claim 15, further comprising the step of:

replenishing the anodic material.

* * * * *